US005405126A

United States Patent [19]

Mack

[11] Patent Number: 5,405,126

[45] Date of Patent: Apr. 11, 1995

[54] FORMAT-VARIABLE COMBINATION FOLDER

[75] Inventor: Richard Mack, Brühl, Germany

[73] Assignee: Heidelberger Druckmaschinen AG, Heidelberg, Germany

[21] Appl. No.: 165,981

[22] Filed: Dec. 13, 1993

[30] Foreign Application Priority Data

Dec. 11, 1992 [DE] Germany ..... 42 41 810.0

[51] Int. Cl.[6] ..... B41F 13/58; B31F 1/08

[52] U.S. Cl. ..... 270/6; 270/21.1; 270/43; 493/424

[58] Field of Search ..... 270/6, 8, 10, 19, 21.1, 270/38, 42, 43; 493/424, 425, 426, 427, 428, 432, 434, 435

[56] References Cited

U.S. PATENT DOCUMENTS

| | | | |
|---|---|---|---|
| 3,544,454 | 12/1970 | Muth et al. | 270/43 X |
| 3,787,041 | 1/1974 | Hertrich | 493/432 X |
| 3,999,454 | 12/1976 | Tiso et al. | 270/21.1 X |
| 4,332,582 | 6/1982 | Hertich | 493/432 X |
| 4,368,879 | 1/1983 | Hoshi | 270/6 |
| 4,720,089 | 1/1988 | Richter | 270/43 |
| 4,799,660 | 1/1989 | Pfizenmaier | 270/21.1 |
| 4,861,326 | 8/1989 | Kühner et al. . | |
| 4,895,356 | 1/1990 | Rudolf | 270/49 |
| 5,080,338 | 1/1992 | Belanger et al. | 270/6 |

FOREIGN PATENT DOCUMENTS

| | | |
|---|---|---|
| 25652 | 9/1906 | Austria . |
| 820998 | 9/1951 | Germany . |
| 1611283 | 11/1975 | Germany . |
| 2512368 | 9/1976 | Germany . |
| 2704813 | 8/1978 | Germany . |
| 3626287 | 2/1988 | Germany . |
| 3628411 | 2/1988 | Germany . |
| 4-75967 | 3/1992 | Japan . |
| 549067 | 11/1942 | United Kingdom . |

*Primary Examiner*—Edward K. Look
*Assistant Examiner*—John Ryznic
*Attorney, Agent, or Firm*—Herbert L. Lerner; Laurence A. Greenberg

[57] ABSTRACT

A folder having, disposed in succession in a web-and-copy traveling direction, at least a first longitudinal folding device, driven severing members, and cross-folding devices formed of folding cylinders to which a first copy delivery is assigned, and a second longitudinal folding device to which folding copies are supplied via a section of a conveyor belt which is disposed over a second loadable copy delivery, includes drawing devices disposed upstream of the severing members in the web-and-copy traveling direction, a first drive for separately and controllably driving the drawing devices, a second drive for driving the severing members and the cross-folding devices, and outwardly swingable conveyor belts having a third copy delivery assigned thereto.

10 Claims, 2 Drawing Sheets

FORMAT-VARIABLE COMBINATION FOLDER

Figure 1:
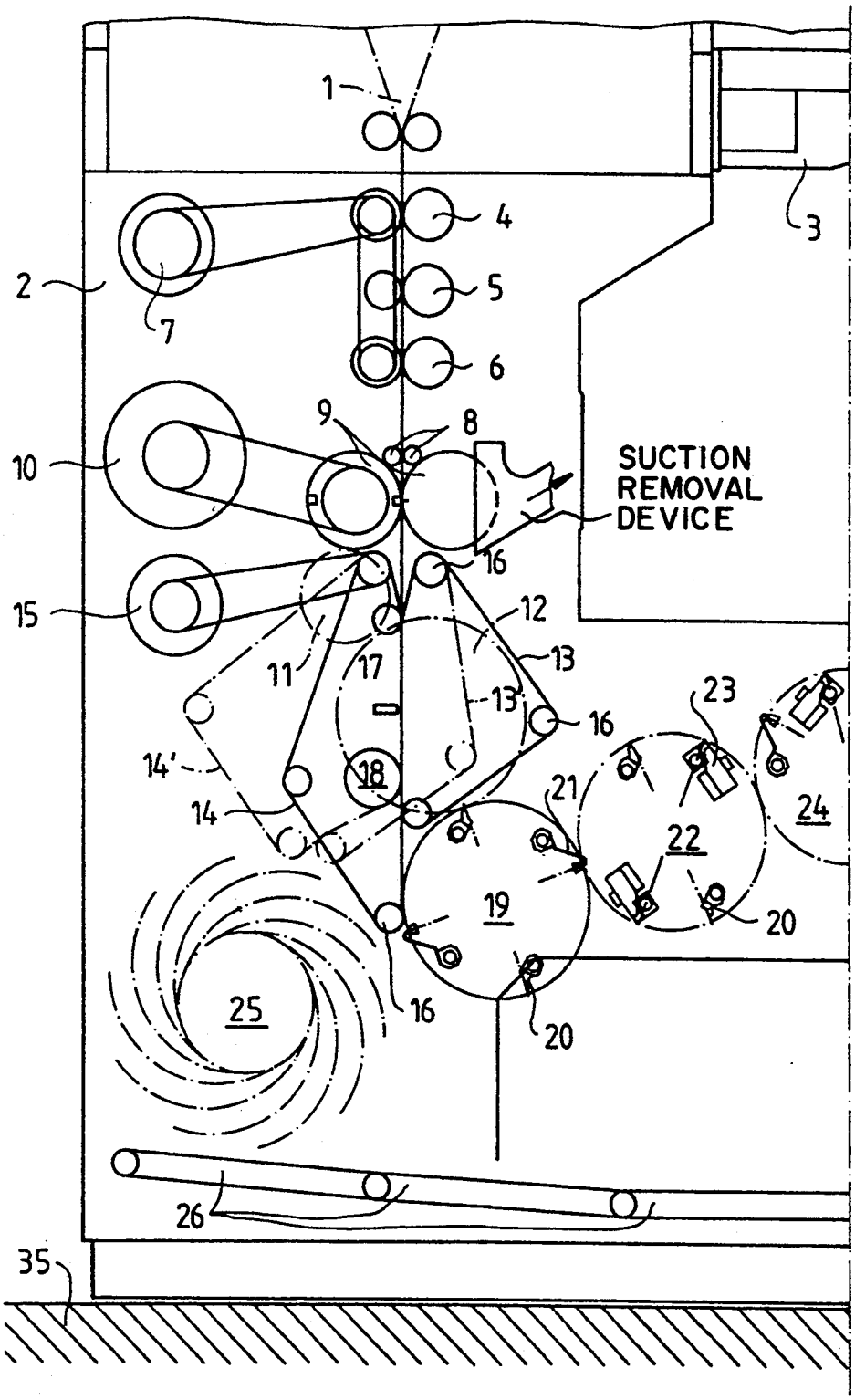

The invention relates to a format-variable combination folder and, more particularly, to a folder having, disposed in succession in a web-and-copy traveling direction, at least a first longitudinal folding device, driven severing members, and cross-folding devices formed of folding cylinders to which a first copy delivery is assigned, and a second longitudinal folding device to which folding copies are supplied via a section of a conveyor belt which is disposed over a second loadable copy delivery.

Published Non-Prosecuted Japanese Patent Application 4-75967 discloses a state-of-the-art folder with which delivery of a product which is only longitudinally-folded or is both longitudinally and cross-folded is possible. Moreover, an additional cylinder permitting the severing of the product is assigned to a cutting cylinder. Beforehand, however, a web of material must, as a whole, be deflected before the product delivery is effected in a continuous sequence in a conveyor-belt system.

From published German Patent Document DE 27 04 813 A1, a folder for rotary printing machines which has a magazine cutting capability has also become known in the state of the art. To this end, below a nip between a collecting cylinder and a cutting cylinder, an additional roller pair, a control tongue and a further paddle wheel are provided in an insert introducible into a base frame of a folder. When the magazine cutting unit is in operation, impaling pins at the circumference of the collecting cylinder can furthermore be put out of operation. The components provided in an additional structural unit are removed from the folder when the magazine cutting unit is not being used. In this heretofore known folder, for each change in production from cross-cutting to tabloid and the reverse, an additional module has to be moved into the folder and then outward therefrom again, respectively.

It has also become known in the state of the art, as exemplified by the published German Patent Document 36 26 287 A1, to provide a cross-cutting device, a drawing or pulling device and an overlapping paddle wheel in an insert frame drivable partly into the base frame of a folder. This makes at least the introduction of the insert frame into the folder and the withdrawal thereof out of the folder necessary.

It is accordingly an object of the invention to provide a format-variable combination folder which avoids the foregoing disadvantages of heretofore known folders of this general type.

With the foregoing and other objects in view, there is provided, in accordance with the invention, a folder having, disposed in succession in a web-and-copy traveling direction, at least a first longitudinal folding device, driven severing members, and cross-folding devices formed of folding cylinders to which a first copy delivery is assigned, and a second longitudinal folding device to which folding copies are supplied via a section of a conveyor belt which is disposed over a second loadable copy delivery, comprising drawing devices disposed upstream of the severing members in the web-and-copy traveling direction, first drive means for separately and controllably driving the drawing devices, second drive means for driving the severing members and the cross-folding devices, and outwardly swingable conveyor belts having a third copy delivery assigned thereto.

Advantages derivable from the foregoing constructions of the folder according to the invention are that by the decoupling of the drives of the cutting and folding systems from the drive of the drawing devices, the copy formats being then used are able to be produced without having to perform any conversions or change-overs. The drawing devices can supply the material web in accordance with the format, while the cutting and cross-folding systems continue to operate cyclically. Because adjustment of the format is effected by acting upon the drives of the drawing and the cutting devices, respectively, and the cross-folding device, impaling and format adjustment can be dispensed with entirely. Due to the outwardly deflectable or swingable conveyor belts provided after the severing members, as viewed in the web-and-copy travel direction, the copies which have only been longitudinally folded, for example, 4×4 or 16 sides, can be guided directly into a delivery paddle wheel, without requiring the folder to be outfitted additionally with insert modules or the like. Because the deflection of the product flow occurs after the severing or cutting location, additional cross-cutting devices, which would otherwise considerably increase the cost of the folder, can be dispensed with.

In accordance with another feature of the invention, the folder includes a separate drive for driving the outwardly swingable conveyor belts. The belt speed is preferably selected so that it corresponds to the circumferential velocity of the folding cylinders.

In accordance with a further feature of the invention, the folder includes a sensor for transmitting pulses to the drive for the outwardly swingable conveyor belts.

In accordance with an added feature of the invention, the sensor is disposed in vicinity of the outwardly swingable conveyor belts.

With the aid of the sensor and the pulses transmitted thereby to the drive of the drawing devices, the positioning of the separated or severed signatures is influenced by controlling or regulating the belt speed between the drawing devices.

In accordance with an additional feature of the invention, the severing members comprise cutting cylinders cooperating in accordance with the scissors-cutting principle.

The heretofore conventional hack-saw cut made by a sawtooth blade can consequently be eliminated, particularly because, heretofore, also due to impaling punctures, subsequent severing and separation of marginal regions of the finished product by means of a separate cut was necessary. By using the scissors-cutting principle together with longitudinal cutting devices a finishing cut of the product can be effected beforehand during the production in the folder, which is of special interest, for example, for a cover or envelope production.

In accordance with yet another feature of the invention, the folder includes a device disposed at the severing members for removing material-web waste. Thus, by the foregoing advantageous arrangement of the severing members in the form of scissors-cutting cylinders, waste pieces of the material web formed during the cutting operation can be removed more easily than had been possible heretofore.

In accordance with yet a further feature of the invention, the third copy delivery comprises a paddle wheel mounted in side frames of the folder, and the outwardly swingable conveyor belts are swingable to a position above the paddle wheel. Accordingly, with no change-over work, the delivery of, for example, a 4×4 or 16-side production by simply pressing a button is assured, without the occurrence of any additional exchange operations.

In accordance with yet an added feature of the invention, the first, second and third copy deliveries comprise respective paddle wheels, and a delivery belt train transiting the folder below the paddle wheels for receiving thereon copies deposited by the paddle wheels.

In accordance with yet an additional feature of the invention, the folder includes rotating longitudinal cutting devices disposed between the drawing devices in the web-and-copy traveling direction for effecting a finished cutting of the copies.

In accordance with a concomitant feature of the invention, the second longitudinal folding device comprises components, and a separate electric motor is provided for phase-controllably driving the components.

Other features which are considered as characteristic for the invention are set forth in the appended claims.

Although the invention is illustrated and described herein as embodied in a format-variable combination folder, it is nevertheless not intended to be limited to the details shown, since various modifications and structural changes may be made therein without departing from the spirit of the invention and within the scope and range of equivalents of the claims.

Figure 2:
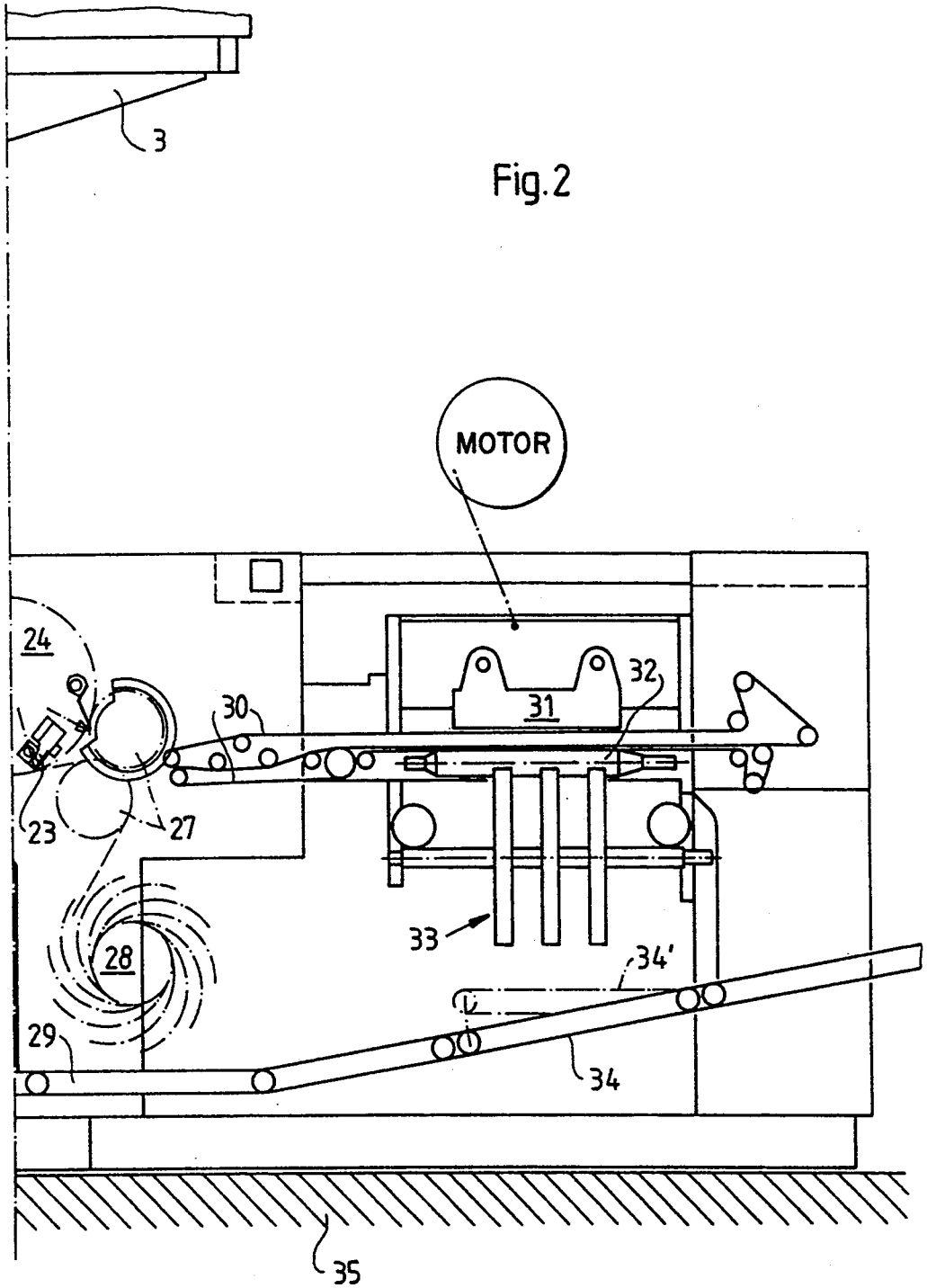

The construction and method of operation of the invention, however, together with additional objects and advantages thereof will be best understood from the following description of specific embodiments when read in connection with the accompanying drawings, in which:

FIGS. 1 and 2 are left-hand and right-hand halves, respectively, of a diagrammatic side elevational view of a folder according to the invention, wherein, below a superstructure, a base frame with drives, cutting members and several folding cylinders are arranged in FIG. 1, and wherein a device for producing a second longitudinal fold is laterally attached to the base frame in FIG. 2.

Referring now to the figures of the drawings, there is shown therein a folder for a printing machine wherein a web of material running into the folder from above and out of the point of a funnel-shaped first-longitudinal folder provided in a superstructure 3 is gripped by a pair of upper infeed rollers 4. The material web may also be formed of a plurality of web strands, as suggested by the two converging lines shown in phantom at the top of FIG. 1, which are brought together from several longitudinal folders in the superstructure 3. The material web running into a base frame of the folder which is formed of side walls 2 is advanced by the upper infeed rollers 4 and lower draw rollers 6 in a direction towards a cutting-cylinder pair 9. Between the upper infeed rollers 4 and the lower draw rollers 6 are longitudinal cutting blades 5 which are displaceable perpendicularly to the travel direction of the web and divide or scratch the material web. The upper infeed rollers 4, which cooperate with the lower draw rollers 6 via a transmission belt, are driven by their own drive 7.

Below the lower draw rollers 6 is a profiling roller pair 8 by which the leading end of the material web is embossed with a stiffening profile and is consequently correctly guidable into the nip between the cutting cylinders 9. The cutting cylinders 9 operate in accordance with the saw-tooth or scissors cut principles, by which a finished cutting of the copy which is yet to be folded is realizable even at this early instant of time due to the superior quality of the cut. Several cutting blades or knives are arranged on the circumferential surfaces of the cutting cylinders 9 and, respectively, cooperate pairwise. By means of a suction removal device assigned to the cutting cylinders 9, any possible residues of the material web which may result from the cutting are removed rather simply. The cutting cylinders 9 are driven by an electric-motor drive 10. From one of the the cutting cylinders 9, the drive is transmitted to a gear 11 which encompasses a superimposed transmission and transmits the drive to a gear 12. By means of the gear 12, the drive introduced via the electric motor 10 is transmitted to a folding cylinder 19, from there to a folding-jaw cylinder 22 and then to a gripper cylinder 24. Furthermore, the drive of the second longitudinal fold (note FIG. 2) can also be effected by the electric motor 10. On the other hand, it is possible to drive the device for producing the second longitudinal fold also phase-controllably via a separate electric motor.

Arranged below the cutting-cylinder pair 9 are outwardly deflectable conveyor belts 13 and 14, between which the severed products or signatures arrive after they have been cut between the cutting cylinders 9. The speed of the outwardly swingable conveyor belts 13 and 14 corresponds preferably to the circumferential speed of the folding cylinder 19, the folding-jaw cylinder 22 and the gripper cylinder 24. The conveyor belts 13 and 14 are swingable into the positions 13' and 14' thereof represented in phantom so as to guide, for example, a 4×4 or 16-sided folding copy into a paddle wheel 25 which then deposits the copies on a delivery belt 26 to the delivery. When the conveyor belts 13 and 14 are swung outwardly due to the application of pressure by adjusting cylinders, guiding or turning rollers 16 are swung outwardly together therewith so that the tension in the conveyor belts 13 and 14 is maintained. A deflecting roller 18, which is mounted between the outwardly swingable conveyor belts 13 and 14, serves to deflect and pre-tension the conveyor belt 13 when it is swung into the position 13' thereof. A sensor 17 is disposed in vicinity of the outwardly swingable conveyor belts 13 and 14 and transmits pulses to a drive 15 of the conveyor belts 13 and 14. Due to the feedback of the pulses of the sensor to the drive 15, the speed of the conveyor belts 13 and 14 can be influenced to a correct positioning of the severed signatures, while the speed of the infeed rollers 4 and the draw rollers 6 may remain unchanged.

If the separated or severed signatures, however, are fed to the cross-folders without making any use of the possibility of deflecting the outwardly swingable conveyor belts 13 and 14, the folding cylinder 19, the folding-jaw cylinder 22 and the gripper cylinder 24 can be phase-adjusted. Thus, for a prescribed cycle of the cutting cylinders 9, assurance can be offered that, in accordance with the sheet-size or format actually being processed, the spacing or distance between the individual cross-fold devices 19, 22 and 24, for example, for a delta or a parallel fold, is correctly set, respectively. The folding cylinder 19 is provided at the periphery thereof with two folding or tucker blades 20, the folding-jaw cylinder 22 herein carries, for example, mutually opposing folding or tucker blades 20 and folding jaws 23.

Gripper bars and folding jaws are provided on the periphery of the gripper cylinder 24.

In FIG. 2., the copy delivery assigned to the cross-fold system as well as the device for forming the second longitudinal fold are illustrated.

After the gripper cylinder 24, in the web or signature travel direction, is a conveyor roller pair 27 below which a paddle wheel 28 is disposed which delivers the cross-folded product or signature to the delivery belt section 29 located under the folder. A further modification of the folder is provided in that the copies are fed via longitudinal-fold feeder belts 30 to a folding blade or chopper 31 of a second longitudinal folder. Below the latter, a delivery of copies occurs from a paddle wheel 33 to a delivery belt swingable between positions 34 and 34' thereof.

The format-variable folder according to the invention, which operates without puncturing or impaling, offers a profusion of production possibilities when the superstructure 3 has a suitable multi-sided configuration. Thus, as mentioned often hereinbefore, a copy production of 4×4 or 16 sides can be passed to the paddle wheel 25 directly after the cut, subsequent to the swinging of the conveyor belts 13 and 14 into the positions 13' and 14' thereof, the copies which have been fully cut on many sides being then deposited by the paddle wheels 25 onto the delivery belt 26. During this operating mode, the after-arranged cross-fold devices, the folding cylinder 19, the folding-jaw cylinder 22 and the gripper cylinder 24 can be stopped, and the device for the second longitudinal fold for 4×4 or 16 sides of copy delivery, as well, can be taken out of operation. The delivered 4×4 or 16 sided copies are thereafter conveyed by the delivery belt system 26, 29 and 34 out of the folder.

A further production possibility is presented in that the conveyor belts 13 and 14 remain in position, and separated or severed signatures pass on to the folding cylinder 19, the folding-jaw cylinder 22 and the gripper cylinder 24 for further processing. Due to the overlapping transmission at the gear 11, a positioning of the signatures between the cutting cylinders 9 and the cross-fold devices 19, 22 and 24 can occur; due to a phase-adjustment between the folding cylinder 19, the folding-jaw cylinder 22 and the gripper cylinder 24, the spacings between the individual folding systems are correctly adjustable in accordance with the size or format to be produced. Because a format-variable material web feeding is permitted by the drive 7 of the infeeding or drawing devices 4 and 6, impaling pins for fixing the products on the periphery of the cross-fold devices can be dispensed with; a control of the cutting register can be effected by the cutting and folding-cylinder drive 10. In a delivery of only a single longitudinal and one or more-times cross-folded copies, the latter may be fed via the paddle wheel 28 to the delivery belt 29; if, on the other hand, the copies are produced with a second longitudinal fold, the thus-processed copies can be delivered by the paddle wheel 33 onto the swingable conveyor belt 34.

I claim:

1. A folder having, disposed in succession in a web-and-copy traveling direction, at least a first longitudinal folding device, driven severing members, and cross-folding devices formed of folding cylinders to which a first copy delivery is assigned, and a second longitudinal folding device to which folding copies are supplied via a section of a conveyor belt which is disposed over a second loadable copy delivery, comprising drawing devices disposed upstream of the severing members in the web-and-copy traveling direction, first drive means for separately and controllably driving said drawing devices, second drive means for driving said severing members and said cross-folding devices, and outwardly swingable conveyor belts having a third copy delivery assigned thereto.

2. Folder according to claim 1, including a separate drive for driving said outwardly swingable conveyor belts.

3. Folder according to claim 2, including a sensor for transmitting pulses to said drive for said outwardly swingable conveyor belts.

4. Folder according to claim 3, wherein said sensor is disposed in vicinity of said outwardly swingable conveyor belts.

5. Folder according to claim 1, wherein said severing members comprise cutting cylinders cooperating in accordance with the scissors-cutting principle.

6. Folder according to claim 5, including a device disposed at said severing members for removing material-web waste.

7. Folder according to claim 1, wherein said third copy delivery comprises a paddle wheel mounted in side frames of the folder, and said outwardly swingable conveyor belts are swingable to a position above said paddle wheel.

8. Folder according to claim 1, wherein said first, second and third copy deliveries comprise respective paddle wheels, and a delivery belt train transiting the folder below said paddle wheels for receiving thereon copies deposited by said paddle wheels.

9. Folder according to claim 1, including rotating longitudinal cutting devices disposed between said drawing devices in the web-and-copy traveling direction for effecting a finished cutting of the copies.

10. Folder according to claim 1, wherein said second longitudinal folding device comprises components, and including a separate electric motor for phase-controllably driving said components.

* * * * *